United States Patent [19]

Burger et al.

[11] Patent Number: 4,982,948

[45] Date of Patent: Jan. 8, 1991

[54] SORTER WITH ROCKING TRAYS

[75] Inventors: William R. Burger; Barry P. Mandel, both of Fairport, N.Y.

[73] Assignee: Xerox Corporation, Stamford, Conn.

[21] Appl. No.: 459,857

[22] Filed: Jan. 2, 1990

[51] Int. Cl.[5] ..... B65H 39/10

[52] U.S. Cl. ..... 271/293; 271/294

[58] Field of Search ..... 271/292, 293, 294; 270/53

[56] References Cited

U.S. PATENT DOCUMENTS

| | | | |
|---|---|---|---|
| 3,788,640 | 1/1974 | Stemmle | 271/64 |
| 4,133,522 | 1/1979 | Siegel | 271/173 |
| 4,337,936 | 7/1982 | Lawrence | 271/293 |
| 4,398,712 | 8/1983 | George | 271/293 |
| 4,478,406 | 10/1984 | DuBois | 271/293 |
| 4,500,087 | 2/1985 | DuBois | 271/293 |
| 4,558,860 | 12/1985 | Stemmle | 271/293 |
| 4,580,775 | 4/1986 | Maruyama | 271/293 |
| 4,772,009 | 9/1988 | Jacobs | 271/293 |
| 4,872,663 | 10/1989 | Latone | 271/294 |

FOREIGN PATENT DOCUMENTS

| | | | |
|---|---|---|---|
| 301594 | 1/1989 | Japan | 270/53 |

*Primary Examiner*—H. Grant Skaggs
*Assistant Examiner*—Carol L. Druzbick

[57] ABSTRACT

In a multi-bin sorter for collating sheets of paper or the like from a fixed sheet output into sets in the bins, with a system for sorter bin loading in which the bins are opened relative to one another adjacent the fixed sheet output, the bins are respectively intermediately pivotally mounted in an array to a common mounting system (with a fixed spacing at their pivotal mounting positions) for common linear vertical movement as an integral unit with a simple drive system, yet individually pivoted open for loading by a fixed pivotal control guide system, preferably a generally linear cam track with a transition for engaging individually integral extensions of said bins to pivot them about their intermediate pivotal mounting into the sorter bin loading position relative to the next adjacent bin, when the bin array is commonly vertically moved by the drive system.

4 Claims, 1 Drawing Sheet

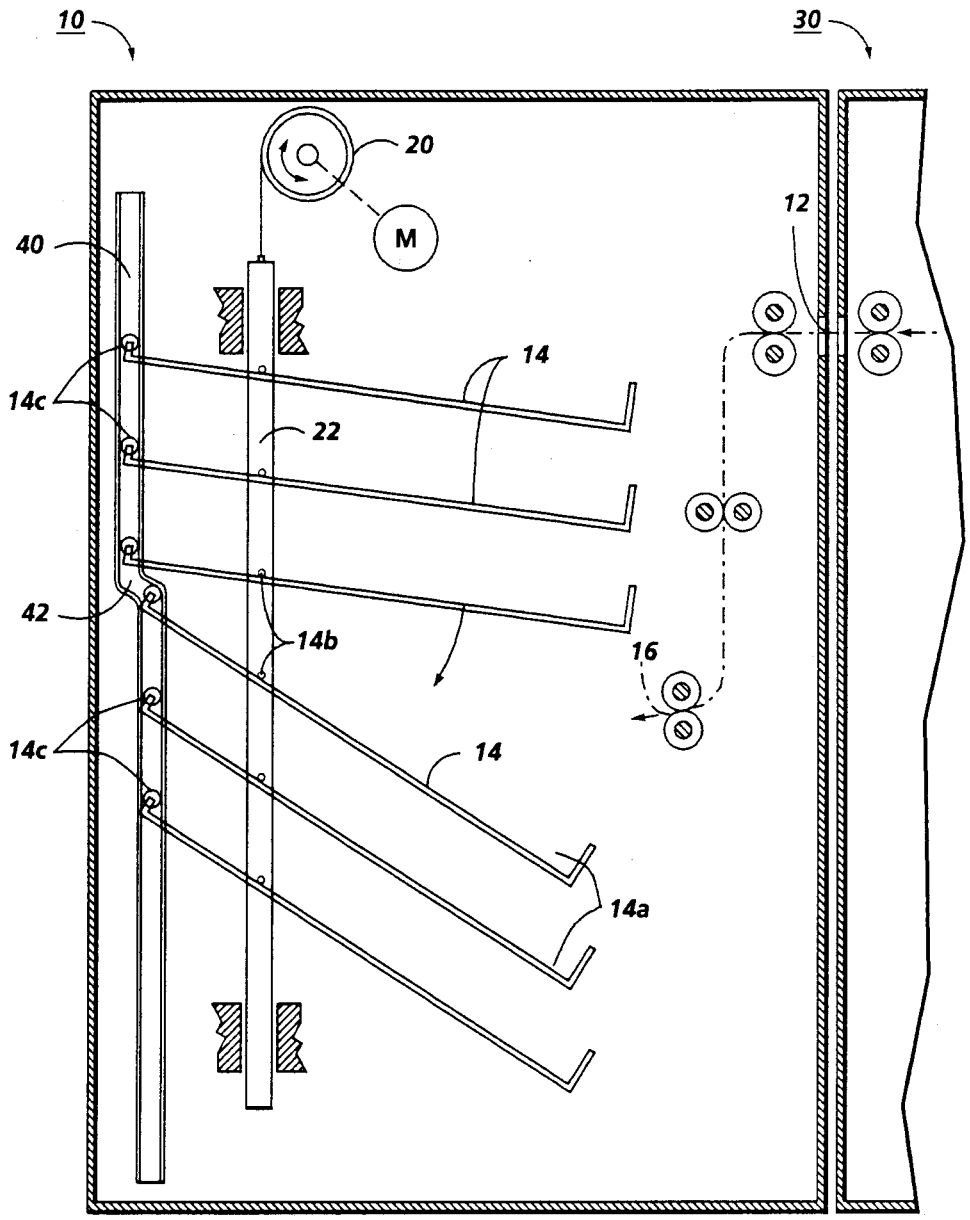
10
30
20
M
12
40
14
14c
22
42
14b
16
14c
14
14a

SORTER WITH ROCKING TRAYS

Cross-reference and incorporation by reference is made to copending allowed U.S. patent application No. 07/241,999 filed Sept. 8, 1988, Attorney Docket No. D/87219, by the same inventors together with William E. Kramer and others, and particularly to the FIG. 3 embodiment thereof which is by these same inventors, William R. Burger and Barry P. Mandel, now U.S. Pat. No. 4,925,171, issued May 15, 1990. If any claim for priority benefit may be made therefore, it is hereby made.

The present invention relates to an improved sorter or collator, for collating sheets of paper or the like into sets, with an improved system of sorter bin loading in which the bins are opened relative to one another for their loading.

Disclosed is sorter system with plural sorting bins (sheet compiling trays) movable as a unit relative to a fixed sheet entry or bin input (bin loading) position, with a system for automatic opening or expansion of the inter-bin spacing adjacent said sheet entry or input position for improved bin loading, wherein said automatic opening or expansion of said inter-bin spacing is accomplished by a system for rocking one bin at a time adjacent said sheet entry position relative to other said bins about an intermediate axis of rotation.

As disclosed herein, preferably the sorter bins are centrally mounted for common vertical movement in a common mounting array with fixed inter-bins spacing but individually pivotable about that mounting array by engagement of a bin with a tipping member as that pin passes that tipping member in the common vertical movement of all of the bins. As disclosed, that tipping member may be a simple transition in a cam track in which a pin or other extension of the outer edge of each bin (opposite the sheet entry or input side) rides.

The disclosed sorter is particularly suitable for known post-collation sorting of the copy sheet output of a copier. E.g., a copier with connected auxiliary plural sorter bins, in one or more sets or modules, in which copier a set of documents are plurally copied during a circulation, for making plural sets of copy sheets therefrom by making a plural number of identical consecutive copies per document per circulation of the document set and respectively outputting these copies to separate sorter bins.

Some examples of recent Xerox Corporation U.S. Patents on sorter with bins which pivot to automatically open or expand the inter-bin spacing adjacent the sheet entry or input position include U.S. Pat. Nos. 4,558,860 (used with the Xerox Corporation "5028" copier); 4,772,009 and 4,398,712. Other such art is noted therein, and in the above-cited U.S. patent application No. 07/241,999. However, as may be seen, they utilize different locations and means for pivoting the bins. Furthermore, they are not the type of sorter in which a large or substantial number of bins can all be reciprocally vertically moved as a bin unit or array relative to a fixed sheet input, with a sheet input with a desirably constant sheet input path distance and transit time, as for example in Xerox Corporation U.S. Pat. No. 3,788,640. Other well known types of sorters in which the sheet must be transported past a variable number of bins by a variable distance until it reaches a selected bin pivoted open to receive it, such as in Xerox Corporation U.S. Pat. No. 4,133,522, are distinguishable in that they have sheet jam detection, jam clearance and other problems associated with the length and variations in the sheet input path distances and transit times to reach the respective bins. Many such sorters are relatively complex and expensive as well, due to their complex transport paths, individual bin gating mechanisms and drives, etc. Yet it is well known that if variable bin opening is not provided, and instead a large inter-bin spacing is provided between all the bins all of the time, then the overall height of the superposed bin array will become too large when a larger number of bins is provided for collating a larger number of copy sets at one time.

In contrast, the disclosed sorter system provides for a simple and low cost bin loading system, does not require individual bin gating mechanisms or drives, and is effectively bin "gated" by a simple bin movement and automatic bin opening, accomplished by the interaction with a simple passive pivotal bin opening means with the same simple common drive that provides the reciprocal vertical movement of all the bins past a fixed, constant path length, sheet input. And the latter is a very simple system in contrast to typical prior art systems of complex helix drives, as in the above-cited U.S. Pat. No. 3,788,640, or Gradco Systems, Inc. U.S. Pat. No. 4,478,406, or the like. Such sorters require a complex system to provide uneven vertical bin movement to provide the bin opening, i.e., the necessary larger spacing between the bins at the sheet entry point to avoid sheet feed-in jams or stacking problems, especially for paper with a curled up lead-edge, as can occur from a copier output. In contrast, a simple even common bin movement system can be provided with the present system.

The disclosed sorter may be readily operated or controlled in a conventional manner with conventional control systems. Some additional examples of various prior art copiers with control systems therefor, including sheet detecting switches, sensors, etc., are disclosed in U.S. Pat. Nos. 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270, and 4,475,156. It is well known in general and preferable to program and execute copier control functions and logic with conventional software instructions for conventional microprocessors. This is taught by the above and other patents and various commercial copiers. Such software may of course vary depending on the particular function and the particular software system and the particular microprocessor or microcomputer system being utilized, but will be available to or readily programmable by those skilled in the applicable arts without undue experimentation from either the provided verbal functional descriptions, such as those provided herein, or prior knowledge of those functions which are conventional, together with general knowledge in the software and computer arts. Controls may alternatively be provided utilizing various other known or suitable hard-wired logic or switching systems.

A specific feature disclosed herein is to provide, in a multi-bin sorter for collating sheets of paper or the like from a fixed sheet output into sets in said bins, with a system for sorter bin loading in which the bins are opened relative to one another adjacent said fixed sheet output for their loading, the improvement wherein said bins are respectively intermediately pivotally mounted in an array to common mounting means with a fixed spacing at said pivotal mounting for substantially common movement as an integral unit; drive means are driveably connected to said common mounting means for movement of said array as an integral unit in a substantially linear direction relative to said fixed sheet output; and bin tipping means are positioned to engage and pivot an individual said bin about said intermediate pivotal mounting thereof into a sorter bin loading position opened for loading at one side of said bin relative to the next adjacent bin when said individual said bin is moved past said bin tipping means by said drive means, and, preferably, wherein said bin tipping means is a passive member engaging said individual said bin on the opposite side of said intermediate pivotal mounting thereof from said one side of said bin which is so opened for loading.

Another specific feature disclosed herein is to provide, in a multi-bin sorter for collating sheets of paper or the like from a fixed sheet output into sets in said bins, with a system for sorter bin loading in which the bins are opened relative to one another adjacent said fixed sheet output for their loading, the improvement wherein said bins are respectively intermediately pivotally mounted in an array to common mounting means with a fixed spacing at said pivotal mounting for substantially common movement as an integral unit; drive means are driveably connected to said common mounting means for movement of said array as an integral unit in a substantially vertical direction past said fixed sheet output; and a fixed guide system is spaced from said common mounting means and said intermediate pivotal mounting positions of said bins thereto, and positioned to engage and pivot an individual said bin about said intermediate pivotal mounting thereof into a sorter bin loading position, opened for loading at one side of said bin relative to the next adjacent bin, when said bin array is commonly vertically moved by said drive means past said fixed guide system, and preferably, wherein said fixed guide system comprises a generally linear cam track individually engaging individually integral extensions of said bins spaced from said intermediate pivotal mounting positions of said bins, said cam track having a transition for forcing and controlling said pivoting of said individual bin being pivoted into said sorter bin loading position when said integral extension of said bin passes through said transition.

All references cited in this specification, and their references, are incorporated by reference herein where appropriate for appropriate teachings of additional or alterative details, features, and/or technical background.

Various of the above-mentioned and further features and advantages of the invention will be apparent from the apparatus and its operation described in the specific example below. Thus, the present invention will be better understood from the following description of this exemplary embodiment thereof, including the drawing figure (approximately to scale) wherein:

The FIGURE is a schematic frontal view illustrating one example of a plural bin sorter module in accordance with the present invention. For illustration clarity a relatively small plurality of bins is illustrated here, although it will be appreciated that the disclosed system is particularly suitable for a sorter with a much larger number of bins operated in the same manner.

Describing now in further detail the specific example illustrated in the FIGURE, there is schematically shown an exemplary sorter 10 with a sheet input path 12 integral the output of a copier 30. The exemplary copier may be for example, the well known Xerox Corporation copiers, as illustrated and described in various patents cited above and otherwise, such as 4,278,344, or various other xerographic or other copiers.

All the plural individual sorting bins 14 (sheet compiling trays) of the sorter 10 are commonly vertically reciprocally moveable as an integral unit by a simple vertical drive system 20 relative to a fixed sheet entry or bin input (bin loading) position 16. As each bin 14 passes or comes adjacent to this bin input position 16, a sheet from the copier 30 is loaded therein. The bin 14 being loaded is automatically pivoted away from the adjacent bin to provide an enlarged bin entry opening at the entry side **14*a* thereof, the side adjacent the input position 16 (here also the side facing the copier 30**).

This automatic opening or expansion of said inter-bin spacing is accomplished by a disclosed simple system for rocking one bin 14 at a time adjacent said sheet entry position 16 relative to the other bins about an intermediate (approximately central) axis of rotation. Here that intermediate axis of rotation is provided by simple pivotal connections **14*b* of each bin 14 to a simple vertical support member 22 (which may be provided at each side of the bins). The support member 22 is mounted for simple linear vertical movement, and is so vertically driven, in bin increments, by the drive system 20. The support member 22 may comprise a solid channel member or the like coextensive with all the bins (not all the bins are shown here). Or it could be a flexible apertured metal belt or tape which rolls up on a drive pulley, or other suitable mounting. Note that these pivotal connections 14*b* remain equally spaced from one another and held by this integral common support member 22 and do not need to vary, unlike a normal bin support. The entire bin mounting array moves vertically as an integral unit of all the bins and their support member 22. The support member 22 is outside of the bins and thus does not interfere with sheet stacking in the bins. Each bin 14 is individually centrally pivotable about its own axis of rotation at 14*b*. This may be provided by a pin extension there at 14*b* from at least one side of each bin 14 into corresponding bearing holes in the support member 22**.

That individual controlled bin pivoting is controlled and accomplished automatically by engagement of a bin with a bin tipping member as that bin passes that tipping member in the common vertical movement of all of the bins. As disclosed here, that tipping member may be a simple discontinuity or horizontal transition 42 in a simple fixed passive vertical guide or cam track 40, in which at least one roller or pin **14*c* or other extension of the outer edge of each bin 14 rides. That is, adjacent the side of the bins 14 opposite the sheet entry or input side 14*a*. This tray tipping or rocking cam track transition 42 is located in a vertical position along the cam track 40 such that, as all the trays and all their rollers 14*c* are moved vertically by drive system 20, the one roller or pin 14*c* of the one tray 14 desired to be pivoted for opening for loading engages the cam track transition 42**. That forces and controls the pivoting of that one bin relative to the next adjacent bin. This can be done in either of the two vertical movement direction of the bins, to allow bi-directional bin loading.

While the embodiment disclosed herein is preferred, it will be appreciated from this teaching that various alternatives, modifications, variations or improvements therein may be made by those skilled in the art, which are intended to be encompassed by the following claims:

We claim:

1. In a multi-bin sorter for collating sheets of paper or the like from a fixed sheet output into sets in said bins, with a system for sorter bin loading in which the bins are opened relative to one another adjacent said fixed sheet output for their loading, the improvement wherein:

said bins are respectively intermediately pivotally mounted in an array to common mounting means with a fixed spacing at said pivotal mounting for substantially common movement as an integral unit;

drive means are driveably connected to said common mounting means for movement of said array as an integral unit in a substantially linear direction relative to said fixed sheet output;

and bin tipping means are positioned to engage and pivot an individual said bin about said intermediate pivotal mounting thereof into a sorter bin loading position opened for loading at one side of said bin relative to the next adjacent bin when said individual said bin is moved past said bin tipping means by said drive means.

2. The multi-bin sorter of claim 1, wherein said bin tipping means is a passive member engaging said individual said bin on the opposite side of said intermediate pivotal mounting thereof from said one side of said bin which is so opened for loading.

3. In a multi-bin sorter for collating sheets of paper or the like from a fixed sheet output into sets in said bins, with a system for sorter bin loading in which the bins are opened relative to one another adjacent said fixed sheet output for their loading, the improvement wherein:

said bins are respectively intermediately pivotally mounted in an array to common mounting means with a fixed spacing at said pivotal mounting for substantially common movement as an integral unit;

drive means are driveably connected to said common mounting means for movement of said array as an integral unit in a substantially vertical direction past said fixed sheet output;

and a fixed guide system is spaced from said common mounting means and said intermediate pivotal mounting positions of said bins thereto, and positioned to engage and pivot an individual said bin about said intermediate pivotal mounting thereof into a sorter bin loading position, opened for loading at one side of said bin relative to the next adjacent bin, when said bin array is commonly vertically moved by said drive means past said fixed guide system.

4. The multi-bin sorter of claim 3, wherein said fixed guide system comprises a generally linear cam track individually engaging individually integral extensions of said bins spaced from said intermediate pivotal mounting positions of said bins, said cam track having a transition for forcing and controlling said pivoting of said individual bin being pivoted into said sorter bin loading position when said integral extension of said bin passes through said transition.

* * * * *